United States Patent [19]

Sato et al.

[11] Patent Number: 4,904,833

[45] Date of Patent: Feb. 27, 1990

[54] SWITCH DEVICE WITH AUTOMATIC NEUTRAL POINT RESTORING POSITION AND RELEASABLY LOCKABLE NONNEUTRAL POSITION

[75] Inventors: Hiroyuki Sato; Yujiro Shimoyama, both of Furukawa, Japan

[73] Assignee: Alps Electric Co., Ltd., Tokyo, Japan

[21] Appl. No.: 235,350

[22] Filed: Aug. 23, 1988

[30] Foreign Application Priority Data

Dec. 14, 1987 [JP] Japan ..... 62-188810

[51] Int. Cl.[4] ..... H01H 21/50

[52] U.S. Cl. ..... 200/557; 200/1 V; 200/553; 200/558; 200/325

[58] Field of Search ..... 200/339, 553, 556, 557, 200/290, 291, 318, 323, 324, 325, 1 V, 6 B, 6 BA, 558, 327, 61.27, 61.3, 61.32

[56] References Cited

U.S. PATENT DOCUMENTS

| | | | |
|---|---|---|---|
| 2,782,279 | 2/1957 | Heusser | 200/6 BA X |
| 2,969,442 | 1/1961 | Benander et al. | 200/556 |
| 3,504,372 | 3/1970 | Sharples | 200/325 X |
| 3,684,850 | 8/1972 | Kaderbek et al. | 200/556 X |
| 4,160,138 | 7/1979 | Brown | 200/325 |
| 4,654,487 | 3/1987 | Sawada | 200/1 V |
| 4,720,614 | 1/1988 | Wulff | 200/553 |
| 4,803,317 | 2/1989 | Sutoh et al. | 200/339 X |

FOREIGN PATENT DOCUMENTS

| | | | |
|---|---|---|---|
| 169623 | 4/1951 | Austria | 200/325 |
| 829759 | 1/1952 | Fed. Rep. of Germany | 200/553 |
| 1088134 | 9/1960 | Fed. Rep. of Germany | 200/325 |
| 3616526 | 11/1986 | Fed. Rep. of Germany | 200/339 |
| 2342184 | 10/1977 | France | 200/318 |
| 56-22736 | 2/1981 | Japan . | |
| 6887783 | 3/1953 | United Kingdom | 200/553 |

*Primary Examiner*—Ernest G. Cusick

*Attorney, Agent, or Firm*—Guy W. Shoup; Gideon Gimlan

[57] ABSTRACT

A switch device comprising an operating knob adapted to be selectively operated according to an operational amount and permit an automatic restoring condition and an automatic locking condition, a first selector member interlocking with the operating knob for effecting a switching operation of contacts, a second selector member engageable with the first selector member for selectively effecting the automatic restoring condition and the automatic locking condition of the operating knob, a switch wafer provided in opposed relationship to the first and second selector members, a locking member adapted to restrict movement of the second selector member, and a resilient member for biasing the locking member toward the second selector member. With this structure, the automatic locking condition may be maintained without the use of a solenoid, thereby reducing the power consumption and heat generation.

9 Claims, 7 Drawing Sheets

SWITCH DEVICE WITH AUTOMATIC NEUTRAL POINT RESTORING POSITION AND RELEASABLY LOCKABLE NONNEUTRAL POSITION

BACKGROUND OF THE INVENTION

The present invention relates to a switch device provided with an operating knob operable to select among among an automatic neutral-point restoring position and an automatic nonneutral point locking position according to an operational amount thereof.

Conventionally, a switch device employed as an opening/closing switch for an automotive power window is known, which device is provided with an operating knob operable to select among an automatic neutral-point restoring position and an automatic nonneutral point locking position according to an operational amount thereof. Such a switch device is disclosed in Japanese Utility Model Laid-Open Publication No. 56-22736.

An example of this kind of known switch device is shown in FIGS. 9 and 10. FIGS. 9 and 10 are a sectional side view and a sectional bottom view of the conventional switch device, respectively. The switch device comprises a case-like switch body 51, an operating knob 52, a selector member 53 to be driven by the operating knob 52, a contact portion 54 to be switched on and off by the selector member 53, and a solenoid 55 for maintaining the selector member 53 in a fixed position.

As shown in FIG. 9, the operating knob 52 has a substantially T-shaped configuration. A vertical member 52*a* of the operating knob 52 is formed at its side surface with pivots 56 horizontally projecting therefrom, so that the operating knob 52 is pivotably mounted to the switch body 51. The vertical member 52*a* is formed with an axial hole opened at its lower end for receiving a spring member 57 and a pin 58. The pin 58 is vertically downwardly biased by the spring member 57. The switch body 51 is formed with a substantially V-shaped plate 59 against which the pin 58 abuts resiliently. In a horizontal position (which will be hereinafter referred to as a neutral position) of the operating knob 52, the pin 58 abuts against a bottom portion 59*a* of the substantially V-shaped plate 59. When the operating knob 52 is operated by an operator to be rocked clockwise and counterclockwise, and the pin 58 is slid along the substantially V-shaped plate 59 beyond an angular portion 59*b* of the plate 59, the operator can feel clicking.

The selector member 53 is provided with a connecting pin 60 to be integrally connected to a lower end portion of the operating knob 52. Accordingly, when the operating knob 52 is depressed at its right end to be rocked clockwise from the neutral position, the selector member 53 is moved leftwardly in interlocking relationship with the operating knob 52. In contrast, when the operating knob 52 is depressed at its left end to be rocked counterclockwise from the neutral position, the selector member 53 is moved rightwardly in interlocking relationship with the operating knob 52.

Movable contacts 61*a* and 61*b* of the contact portion 54 are mounted on opposite ends of the selector member 53. In the neutral position of the operating knob 52, the movable contacts 61*a* and 61*b* are electrically connected with a first fixed contact 62. In association with the movement of the selector member 53, the movable contacts are selectively brought into electrical connection with a second fixed contact 63.

A pair of plunger retainer arms 53*a* extend from the opposite ends of the selector member 53 for retaining a plunger 55*a* of the solenoid 55. In the neutral position of the operating knob 52, a body of the solenoid 55 is located at a central position of the plunger 55*a*, and is fixed to the switch body 51.

In operation, when the operating knob 52 is operated to move the selector member 53 rightwardly or leftwardly, the movable contacts 61*a* and 61*b* are selectively brought into electrical connection with the fixed contacts 62 and 63. In the case that the operating knob 52 is depressed within an operating range where the pin 58 contacts a slant surface of the substantially V-shaped plate 59, when the depressed force is removed, the selector member 53 is automatically returned to the neutral position by an elastic force of the movable contacts 61*a* and 61*b* or the like. In the case that the operating knob 52 is depressed until the pin 58 moves beyond the angular portion 59*b* of the substantially V-shaped plate 59, the solenoid 55 is excited to automatically lock the plunger 55*a* and the selector member 53 in this position. Accordingly, even when the depression force is removed, the contacts are maintained in the on-state.

Accordingly, when the switch device is applied to an opening/closing switch for an automotive power window, for example, the window may be opened or closed by a desired amount by operating the operating knob 52 under the automatic neutral-point restoring condition, and the opening/closing operation of the window may be automatically stopped by releasing the manual operation of the operating knob 52. The operator need not manually restore the operating knob 52 to the neutral position under this position. Further, the window may be automatically opened or closed to a full open or full closed position by operating the operating knob 52 to the automatic nonneutral point locking position. In this condition, the operator does not need to continue to press the operating knob 52 until the window reaches the full open or closed position. Solenoid 55 holds the switch in the nonneutral position until the window is fully opened or closed and then releases the switch, allowing it to automatically restore itself to the neutral position.

However, in the above-mentioned conventional switch device, when the operating knob 52 is operated to the automatic nonneutral point locking position, the solenoid 55 continues to be excited until the automatic locking condition is released, so as to maintain the automatic locking condition. Therefore, power consumption is increased, and heat generation is also increased, which is a most important problem in an on-vehicle electrical equipment.

SUMMARY OF THE INVENTION

It is an object of the present invention to provide a switch device which may ensure a sufficient peripheral space around the switch device.

It is another object of the present invention to provide a switch device which may reduce power consumption and heat generation.

According to the present invention, there is provided a switch device comprising an operating knob adapted to be selectively operated according to an operational amount and permit an automatic neutral point restoring condition and an automatic nonneutral point locking condition, a first selector member interlocking with said operating knob for effecting a switching operation of contacts, a second selector member engageable with said first selector member for selectively effecting the automatic neutral point restoring condition and the automatic nonneutral point locking condition of said operating knob, a switch wafer provided in opposed relationship to said first and second selector members, a locking member adapted to restrict movement of said second selector member, and a resilient member for biasing said locking member toward said second selector member.

In operation, when the operating knob is depressed to select the automatic neutral point restoring condition, a driving rod of the first selector member is raised along a slant surface of a V-shaped groove in the wafer, while when the depression force is removed, the driving rod is returned to a trough portion of the V-shaped groove by a restoring force of a first spring, thus effecting the automatic neutral point restoring operation. On the other hand, when the knob is further depressed to select the automatic nonneutral point locking condition, a cam of the second selector member operates to downwardly urge a rod portion of the locking member to a position such that the engagement of the cam with a cam surface of the rod portion is broken and this allows the locking member to be lifted by a restoring force of a second spring to a natural switch locking position. Simultaneously, the driving rod of the second selector member is returned to a trough portion of a conductor plate by a restoring force of a third spring. As a result, the cam of the second selector member is returned toward the neutral position, but is lockingly engaged with the rod portion, thereby locking the second selector member in this position. Thus, the automatic neutral point restoring condition and the automatic nonneutral point locking condition are selectively obtained.

As mentioned above, since no solenoid is used in both the automatic neutral point restoring operation and the automatic nonneutral point locking operation, the power consumption and heat generation may be reduced. A releasing operation of the automatic nonneutral point locking condition may be effected by depressing the knob at a position opposite the depressed position of the automatic nonneutral point locking operation without the use of the solenoid.

Further, since the first selector member, the second selector member, the switch wafer and the locking member are vertically disposed in a stacked fashion, a sufficient peripheral space around the switch device may be ensured, and this is advantageous when a plurality of switches are arranged in parallel at a narrow area in a compartment of a vehicle.

Other objects and features of the invention will be more fully understood from the following detailed description and appended claims when taken with the accompanying drawings.

DETAILED DESCRIPTION OF THE PREFERRED EMBODIMENT

Figure 1:
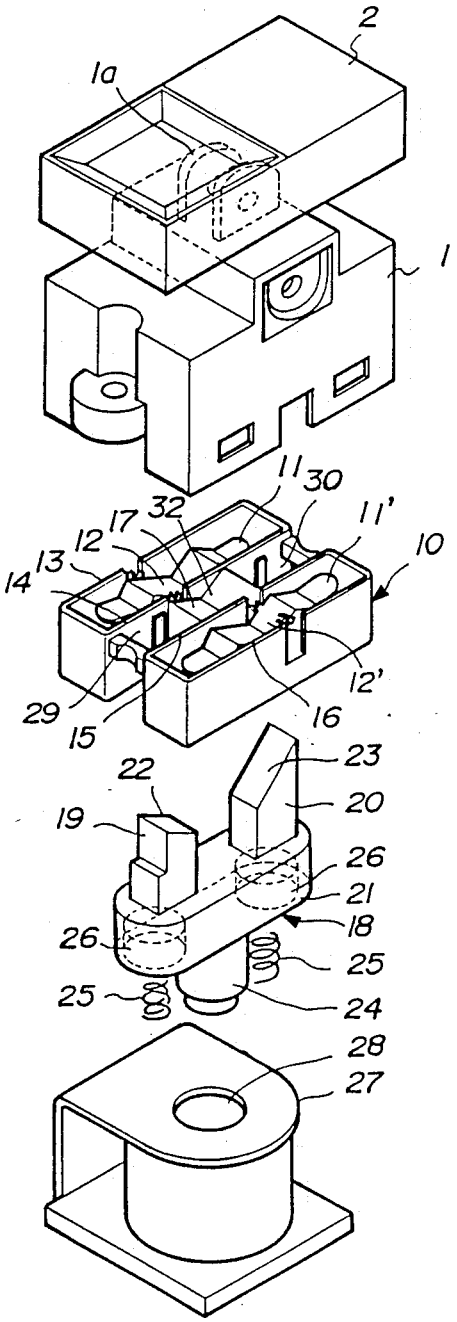
FIG. 1 is an exploded perspective view of the switch device of a preferred embodiment according to the present invention.
Figure 2:
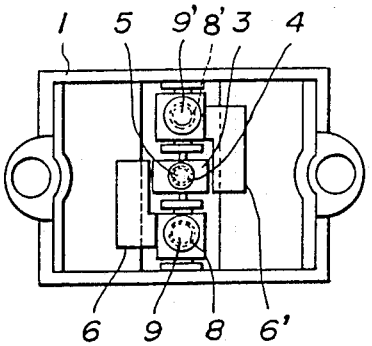
FIG. 2 is a bottom plan view of the switch wafer shown in FIG. 1.

Referring to FIGS. 1 to 4, reference numeral 1 designates a case having a projection 1*a*. A knob 2 is formed at its central portion with a stem 3 (primary selector member) extending downwardly. The stem 3 is pivotably supported to the projection 1*a* of the case 1. The stem 3 is formed with an axial hole opened at a lower end thereof. A driving rod 5 is inserted into the axial hole of the stem 3 with a compression spring 4 interposed between the driving rod 5 and the bottom of the axial hole.

Reference numerals 6 and 6′ designate respective left and right secondary selector members disposed on opposite sides of the lower end portion of the stem 3 and pivotably supported to the case 1. The secondary selector members 6 and 6′ have a substantially L-shaped configuration and are disposed in symmetrical relationship with respect to the stem 3. The secondary selector members 6 and 6′ are formed at their respective first ends thereof with cams 7 and 7′ extending downwardly, and are formed at the respective other ends with axial holes for receiving compression springs 8 and 8′ and driving rods 9 and 9′.

Figure 3A:
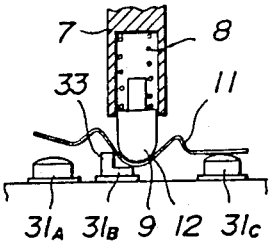
FIGS. 3(A) and 3(B) are illustrations of the switching mechanism of a switch under an inoperative condition and an operative condition, respectively.
Figure 3B:
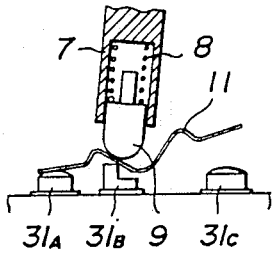
Figure 4A:
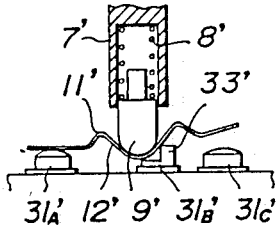
FIGS. 4(A) and 4(B) are illustrations of the switching mechanism of another switch under an inoperative condition and an operative condition, respectively.
Figure 4B:
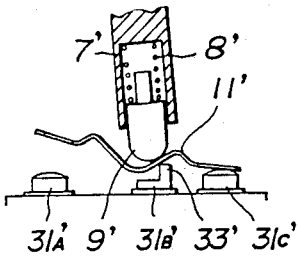

Reference numeral 10 generally designates a switch wafer to be engaged with the case 1. The switch wafer 10 is equipped with conductor plates 11 and 11′ bent or corrugated. As shown in FIG. 3(A) under the neutral or rest condition, the driving rod 9 is resiliently biased by the compression spring 8 against a trough portion 12 of the conductor plate 11, and a left slope of the trough portion 12 abuts against an upright portion 33 of a central terminal 31B serving as a fulcrum. Under a nonneutral condition, as shown in FIG. 3(B), the conductor plate 11 is rockably supported between side walls 13 and 14 (FIG. 1) of the switch wafer 10 so as to break contact between terminals 31B and 31C while making contact between terminals 31B and 31A. Similarly, as shown in FIG. 4(A) under the neutral or rest position, the driving rod 9′ of cam 7′ is resiliently biased by the compression spring 8′ against a trough portion 12′ of the conductor plate 11′, and a right slope of the trough portion 12′ abuts against an upright portion 33′ of a central terminal 31B′ serving as a fulcrum. Under a nonneutral condition, the conductor plate 11′ is rockably supported between side walls 15 and 16 (FIG. 1) of the switch wafer 10 so as to break contact between terminals 31B′ and 31A′ while making contact between terminals 31B′ and 31C′.

Figure 5:
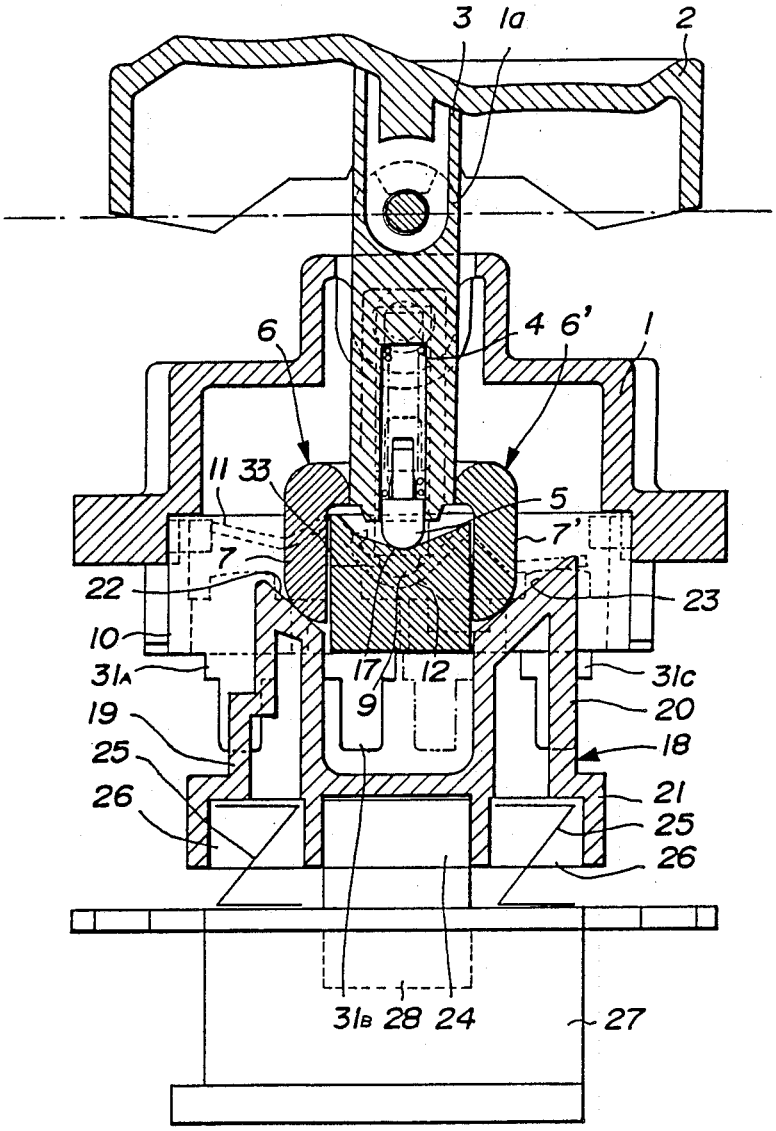
FIG. 5 is a vertical sectional view of the switch device under the neutral condition.

The switch wafer 10 is integrally formed with a V-shaped groove 17 at a central position between the side walls 14 and 15 (FIG. 1). As shown in FIG. 5, the driving rod 5 of stem 3 is resiliently biased by the compression spring 4 against the V-shaped groove 17.

Reference numeral 18 generally designates a locking member having a first rod portion 19 projecting upright, a second rod portion 20 also projecting upright, and a lateral body portion 21 connecting the first and second rod portions 19 and 20. The first rod portion 19 is shorten than the second rod portion 20. The first rod portion 19 is formed at its top portion with a slant surface 22 inclined upwardly from the right to the left, while the second rod portion 20 is formed at its top portion with a slant surface 23 inclined upwardly from the left to the right. The slant surface 23 is longer than the slant surface 22.

The lateral body portion 21 is formed at its central position of the lower surface with a plunger 24 depending therefrom, and is formed at the laterally opposite positions with holes 26 for receiving compression springs 25 therein. A solenoid 27 is located below the locking member 18 in opposed relationship thereto. The solenoid 27 is formed with a hole 28 for receiving the plunger 24 of the locking member 18. Thus, the locking member 18 is disposed on the upper surface of the solenoid 27 with the plunger 24 inserted into the hole 28 of the solenoid 27, and is resiliently urged by the compression springs 25 inserted in the holes 26 toward the secondary selector members 6 and 6'. The first rod portion 19 of the locking member 18 is inserted into a through-hole 29 of the wafer 10 to resiliently abut against the cam 7 of the secondary selector member 6. Similarly, the second rod portion 20 is inserted into a through-hole 30 of the wafer 10 to resiliently abut against the cam 7' of the right secondary selector member 6'.

There will now be described the operation of the switch device with reference to FIGS. 5 to 8.

Referring now to FIG. 5 which shows the neutral position of the knob 2, the driving rod 5 is resiliently biased by the compression spring 4 against a trough portion 32 of the V-shaped groove 17 of the wafer 10. Simultaneously as shown in FIG. 3(A), the driving rod 9 of the left secondary selector member 6 is resiliently biased by the compression spring 8 against the trough portion 12 of the conductor plate 11 at a right position of the central terminal 31B which acts as the fulcrum. Under this condition, a right terminal 31C is electrically connected with the conductor plate 11 at its right end, while a left terminal 31A is electrically disconnected from the conductor plate 11 at its left end. Accordingly, the left terminal 31A is electrically disconnected from the central terminal 31B, thereby effecting an open circuit condition between terminals 31A and 31B.

Figure 6:
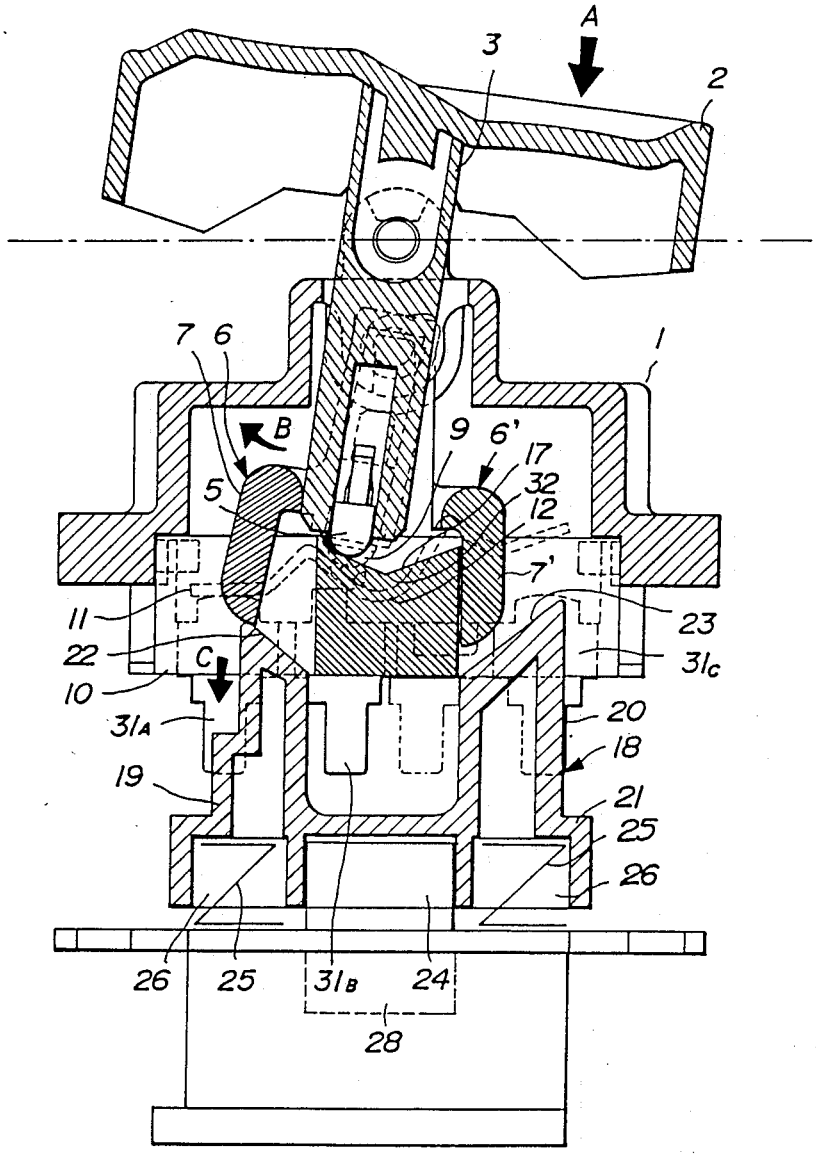
FIG. 6 is a vertical sectional view of the switch device under the automatic neutral point restoring condition.

When the knob 2 is depressed at its right end as shown by the arrow A in FIG. 6 from the neutral position, the stem 3 is rotated clockwise to make the driving rod 5 rise along the left slant surface of the V-shaped groove 17 and simultaneously urge the cam 7 of the left secondary selector member 6 to rotate clockwise as shown by the arrow B. As a result, a lower arcuate portion of the cam 7 rises along the slant surface 22 of the first rod portion 19 of the locking member 18 to downwardly urge the first rod portion 19 as shown by the arrow C. On the other hand, the driving rod 9 of the left secondary selector member 6 is also rotated with the cam 7 as shown by the arrow B, and rises along the left slant surface of the trough portion 12 of the conductor plate 11 beyond the fulcrum. As a result, the conductor plate 11 comes into electrical connection at its left end with the left terminal 31A, as shown in FIG. 3(B), while the right end of the conductor plate 11 comes into electrical disconnection from the right terminal 31C. Thus, the left terminal 31A is electrically connected through the conductor plate 11 to the central terminal 31B, thereby effecting an operative condition.

When the depression force applied to the left end of the knob 2 is removed, the driving rod 5 is returned to the trough portion 32 of the V-shaped groove 17 of the wafer 10 by the restoring force of the compression spring 4. Similarly, the driving rod 9 of the left secondary selector member 6 is also returned beyond the fulcrum to the trough portion 12 of the conductor plate 11 by the restoring force of the compression spring 8. Thus, the neutral position shown in FIG. 5 is restored.

Figure 7:
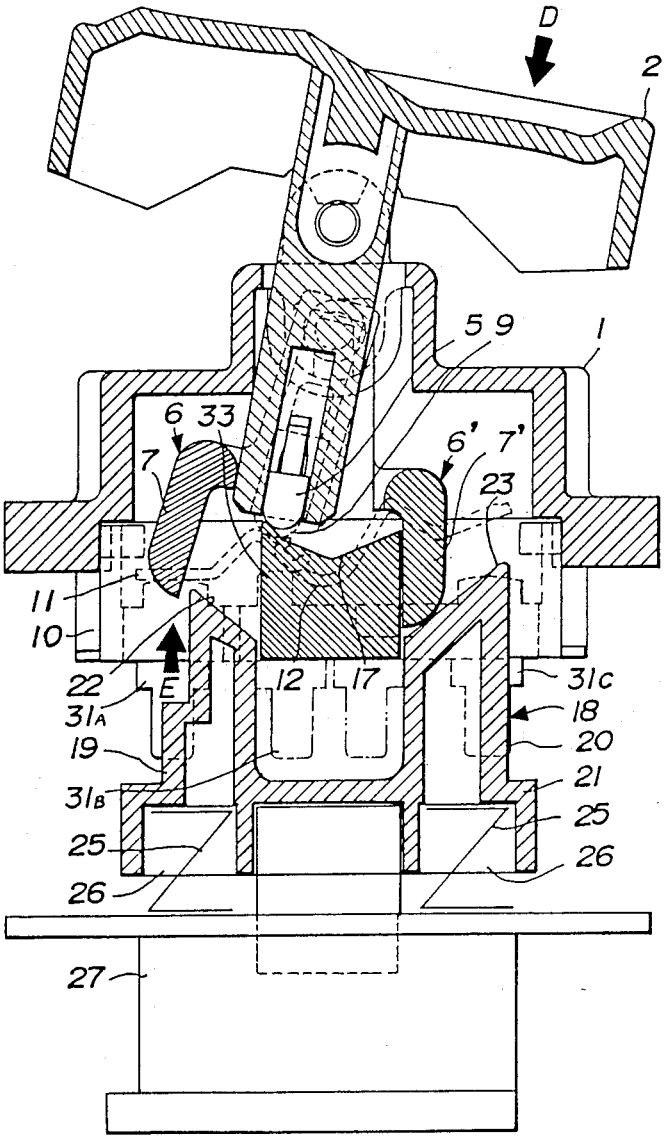
FIG. 7 is a vertical sectional view of the switch device under the automatic nonneutral point locking condition.

Referring to FIG. 7, when the knob 2 is further depressed at its right end as shown by the arrow D in FIG. 7 beyond the position shown in FIG. 6 to a nonneutral point locking position shown in FIG. 7, the cam 7 of the left secondary selector member 6 disengages with the slant surface 22 of the first rod portion 19 of the locking member 18. As a result, the locking member 18 is resiliently urged by the restoring force of the compression springs 25 to be returned towards its neutral position as shown by the arrow E in FIG. 7. Under this condition, when the depression force applied to the knob 2 is removed, the cam of the left secondary selector member 6 begins to automatically return to its neutral point in the same manner as described previously, however the cam 7 of the left secondary selector member 6 comes into engagement with the top of the first rod portion 19, and the left cam 7 is stopped in the nonneutral position. Under such a locked condition, the left end of the conductor plate 11 is maintained under electrical connection with the left terminal 31A as shown in FIG. 3(B).

The other (right) secondary selector member 6' is operated similarly to the left secondary selector member 6. The operation will now be described briefly. When the knob 2 is depressed at its left end from the neutral position, the stem 3 rotates the right secondary selector member 6' counterclockwise. As a result, the open circuit condition shown in FIG. 4(A) where only a left terminal 31A' is electrically connected through the conductor plate 11' to a central terminal 31B' is switched into the closed circuit condition shown in FIG. 4(B) where the right terminal 31C' is electrically connected through the conductor plate 11' to the central terminal 31B'. An automatic nonneutral point locking condition is also similarly selected, and the explanation thereof is therefore omitted here.

Figure 8:
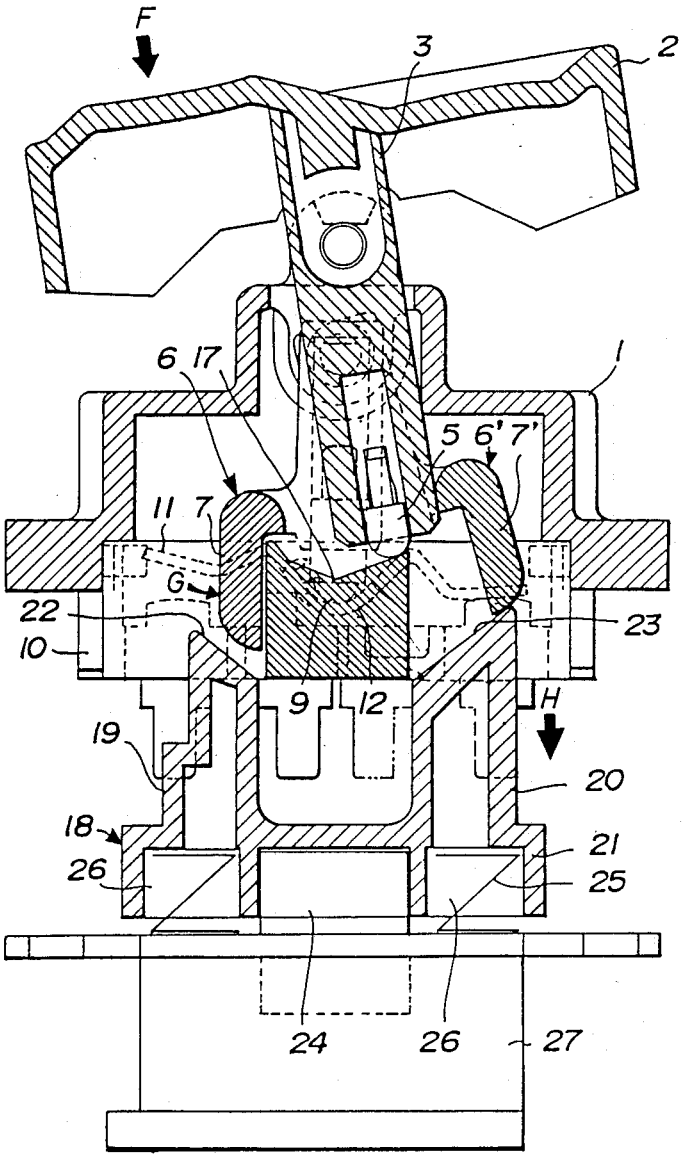
FIG. 8 is a vertical sectional view of the switch device under the automatic lock releasing condition.
Figure 9:
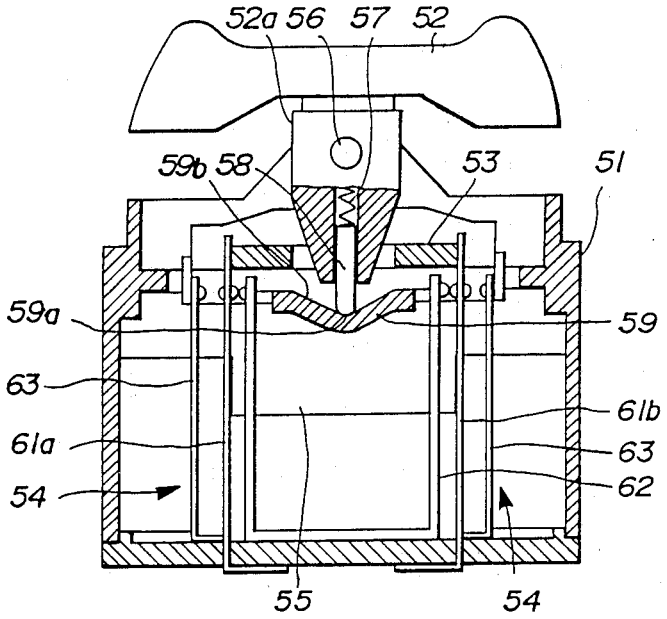
FIG. 9 PRIOR ART
FIG. 9 is a sectional side view of the conventional switch device.
Figure 10:
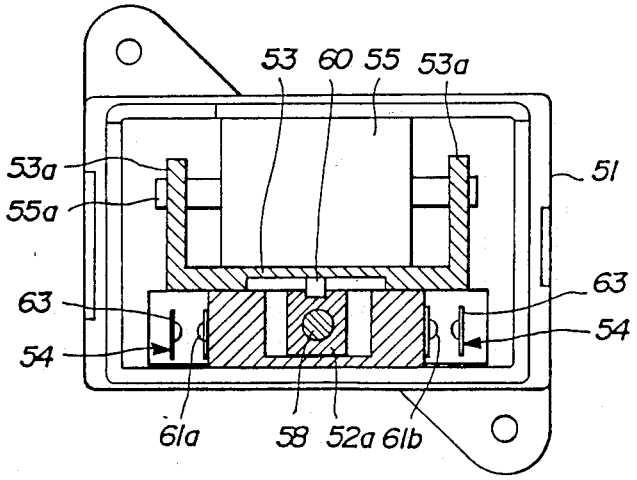
FIG. 10 PRIOR ART
FIG. 10 is a sectional bottom view of the conventional switch device shown in FIG. 9.

In releasing the automatic nonneutral point locking condition shown in FIG. 7, the knob 2 is depressed at its left end as shown by the arrow F in FIG. 8. As a result, the cam 7' of the right secondary selector member 6' downwardly urges the slant surface 23 of the second rod portion 20 of the locking member 18 as shown by the arrow H. At the same time, the slant surface 22 of the first rod portion 19 disengages from the cam 7 of the left secondary selector member 6. As a result, the cam 7 is returned to the neutral position as shown by the arrow G in FIG. 8, and the knob 2 and right secondary selector member 6' are accordingly returned to the neutral position by the restoring forces of respective compression springs 4 and 8.

Alternatively, the nonneutral point locking condition may be released by supplying current to the solenoid 27 to lower the plunger 24 and thereby lower the locking member 18.

According to the switch device in the above preferred embodiment, the first selector member 3, the secondary selector members 6 and 6', the switch wafer 10, the locking member 18 and the solenoid 27 are disposed vertically in a stacked fashion. Accordingly, a sufficient peripheral space around the switch device may be ensured, and this is advantageous for parallel arrangement of plural switches at a narrow area in a compartment of a vehicle.

Further, the stem 3 is resiliently engaged with the V-shaped groove 17 of the wafer 10, and the cams 7 and 7' of the secondary selector members 6 and 6' are resiliently engaged with the slant surfaces 22 and 23 of the first and second rod portions 19 and 20 of the locking member 18. The depression of the knob 2 is followed by the rotation of the secondary selector members 6 and 6' in association with the stem 3. Simultaneously, the rotation of the secondary selector members 6 and 6' is converted into the vertical movement of the locking member 18. Thus, the automatic neutral point restoring operation and the automatic nonneutral point locking operation are effected without the use of the solenoid 27, thereby reducing power consumption and heat generation.

Further, as the switch device in the above preferred embodiment includes the two secondary selector members 6 and 6' and the two pairs of terminal groups 31A, 31B, 31C and 31A', 31B', 31C', the on/off operation of the two switches may be independently effected by selecting the operational direction of the knob 2. Accordingly, when the switch device is applied to an automotive power window, for example, the opening and closing operations of the power window may be effected by the single switch device.

Additionally, the height of the first rod portion 19 of the locking member 18 is smaller than that of the second rod portion 20 in the above preferred embodiment. With this structure, even when the knob 2 is depressed at its left end from the neutral position shown in FIG. 5 to the automatic nonneutral point locking position, the engagement between the cam 7' of the secondary selector member 6' and the top of the rod portion 20 is not released, thus hindering the automatic nonneutral point locking operation of the knob 2. Accordingly, when the switch device is applied to the automotive power window, the automatic nonneutral point locking operation is prevented when the window is being closed, so that it is possible to prevent any accident such that of a driver's or passenger's hand finger or head being caught by the window.

While the invention has been described with reference to a specific embodiment, the description is illustrative and is not to be construed as limiting the scope of the invention. Various modifications and changes may occur to those skilled in the art without departing from the spirit and scope of the invention as defined by the appended claims.

What is claimed is:

1. A toggle switch having a neutral position and first and second nonneutral positions, the switch comprising:

a stem member, operable to move in opposed first and second directions;

a first movable selector member having a stem driven portion and a cam portion, the first selector member being positioned to have its stem driven portion pushed by the stem member only in the first of the opposed directions;

a second movable selector member having a stem driven portion and a cam portion, the second selector member being positioned to have its stem driven portion pushed by the stem member only in the second of the opposed directions; and a capture-and-release member having opposed first and second slanted surfaces respectively engagable with the cam portions of the first and second selector members, the capture-and-release member being biased against the cam portions such that when the first selector member is moved in the first direction, the capture-and-release member will be urged in a third direction until the cam portion moves beyond the first slanted surface, at which point the capture-and-release member moves in a fourth direction opposite the third direction to trap the first selector member in a nonneutral switch position.

2. An electrical switch comprising:

an operating knob movable to at least a neutral position, an automatic neutral point restoring position and a releasably lockable nonneutral point position;

a primary selector member coupled to the operating knob;

first and second secondary selector members, movable independently of the primary selector member but being disposed respectively to be urged in opposed first and second directions by the primary selector member when the primary selector member is moved in one of the first and second directions, each secondary selector member having a cam portion;

a locking member having first and second rod portions extending in a third direction, the first and second rod portions having respective and opposed first and second slanted surfaces, the first and second slanted surfaces being respectively disposed to engage with the cam portions of the first and second secondary selector members such that when one of the first and second secondary selector members moves in a respective one of the first and second directions, the locking member will be urged to move in the third direction; and solenoid means operatively coupled to the locking member for moving the locking member in the third direction.

3. A switch device having an automatic neutral point restoring operation and an automatic nonneutral point locking operation, comprising:

a primary selector member movable between a neutral position and a nonneutral position;

a secondary selector member movable between a neutral point and a nonneutral point independently of the primary selector member, the secondary selector member being biased toward the neutral point and being disposed to engage with the primary selector member such that when the primary selector member is moved from the neutral position to the nonneutral position, the secondary selector member will be urged from the neutral point toward the nonneutral point; and a moveable locking member, engagable with the secondary selector member, for releasably holding the secondary selector member at the nonneutral point.

4. The switch device of claim 3 further comprising:

magnetic means for moving the locking member such that the locking member releases its hold of the secondary selector member and thereby allows the secondary selector member to return to the neutral point.

5. The switch device of claim 3 further comprising a frame, wherein the secondary selector member is pivotally mounted to the frame.

6. The switch device of claim 5 wherein the locking member is reciprocally disposed in the frame.

7. The switch device of claim 3 further comprising a first driving rod biasingly coupled to the primary selector member and a second driving rod biasingly coupled to the secondary selector member.

8. The switch device of claim 7 further comprising:

a frame having a substantially V-shaped groove defined therein, the first driving rod being engaged with the V-shaped groove.

9. The switch device of claim 8 further comprising a conductor plate having a substantially U-shaped portion, the second driving rod being engaged with the U-shaped portion of the conductor plate.

* * * * *